US005207549A

United States Patent [19]

Riva

[11] Patent Number: 5,207,549

[45] Date of Patent: May 4, 1993

[54] TRANSFER SEAT TO BE USED BETWEEN A WHEELCHAIR AND AN AUTOMOBILE SEAT

[76] Inventor: Matthew Riva, 581 Bluebird La., Largo, Fla. 34640

[21] Appl. No.: 662,451

[22] Filed: Feb. 28, 1991

[51] Int. Cl.[5] ..... A61G 3/00

[52] U.S. Cl. ..... 414/340; 296/63; 297/416; 297/DIG. 4; 414/921; 414/744.2; 280/304.1; 224/273

[58] Field of Search ..... 414/921, 537, 462, 522, 414/340, 343, 345, 744.2; 296/63, 65.1, 69; 280/250.1, 304.1; 297/DIG. 4, 440, 416, 217; 224/273

[56] References Cited

U.S. PATENT DOCUMENTS 1,635,575 7/1927 Cole ..... 297/DIG. 4 X
2,653,649 9/1953 Linquist .
3,341,864 9/1967 Wichmann ..... 297/416 X
3,484,877 12/1969 Petersen ..... 297/416 X
4,155,588 5/1979 Dangiger .
4,170,368 10/1979 Southward .
4,288,124 9/1981 Hamilton .
4,354,791 10/1982 Antonellis .
4,479,752 10/1984 Todd ..... 414/921 X
4,592,562 6/1986 Strutnieks .

FOREIGN PATENT DOCUMENTS 2718484 11/1978 Fed. Rep. of Germany ..... 296/63

*Primary Examiner*—Frank E. Werner
*Attorney, Agent, or Firm*—Robert L. Marsh

[57] ABSTRACT

A transfer seat permits a wheelchair bound patient to transfer from the wheelchair to the seat of an automobile. A peg on one side of the frame of the seat slides within a vertical tube used to support a removable arm of the wheelchair. The frame further provides for feet on the other side of the seat adapted to rest on the lower door frame of the automobile and support the transfer seat.

1 Claim, 4 Drawing Sheets

TRANSFER SEAT TO BE USED BETWEEN A WHEELCHAIR AND AN AUTOMOBILE SEAT

The present invention relates generally to a transfer seat to be used in connection with a wheelchair, and specifically to a seat which permits a patient to slide from a wheelchair to the seat of an automobile.

BACKGROUND OF THE INVENTION

Many people who are confined to a wheelchair are totally unable to stand under their own strength and therefore find it very difficult to transfer from a wheelchair into the seat of an automobile. A typical automobile door swings open at an angle substantially less than 90° from the door frame. This angle prohibits a wheelchair from being positioned such that the seat of the wheelchair is parallel to the seat of the automobile. Usually the seat of the wheelchair cannot be brought closer than several inches behind the seat of the automobile and when this position is reached, the wheelchair is angled with it's front slightly towards the automobile. When a wheelchair is so positioned, a very small space exists in the crook between the door, the door frame and the wheelchair, such that, it is difficult or impossible for an assistant to position himself within the crook to assist the patient transferring between the two seats.

GENERAL DESCRIPTION OF THE DRAWING

The present invention will be better understood by reading the following detailed description taken in connection with the accompanying drawings wherein.

Figure 1:
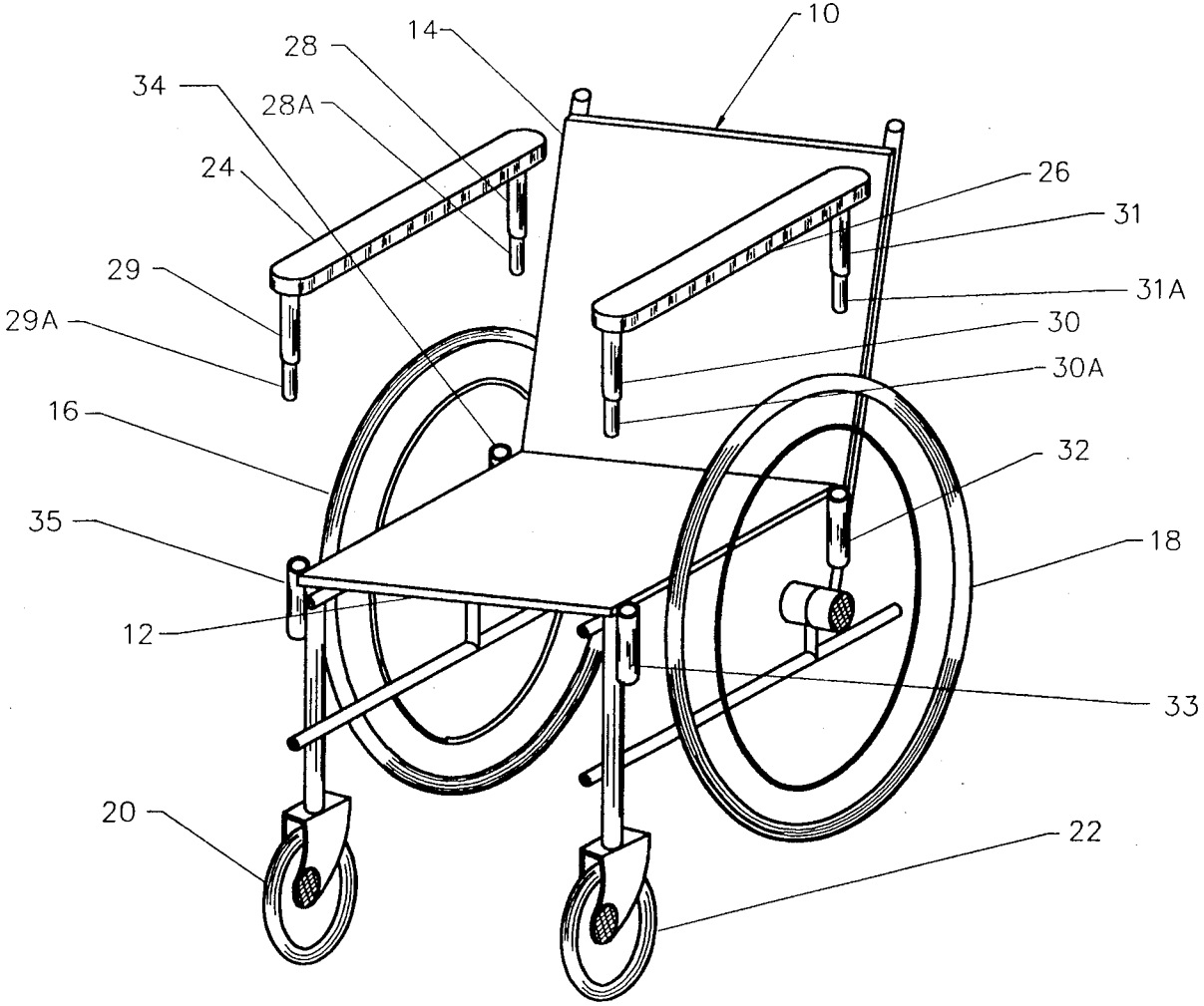
FIG. 1 is an isometric view of a wheelchair with the arms exploded off the chair.
Figure 4:
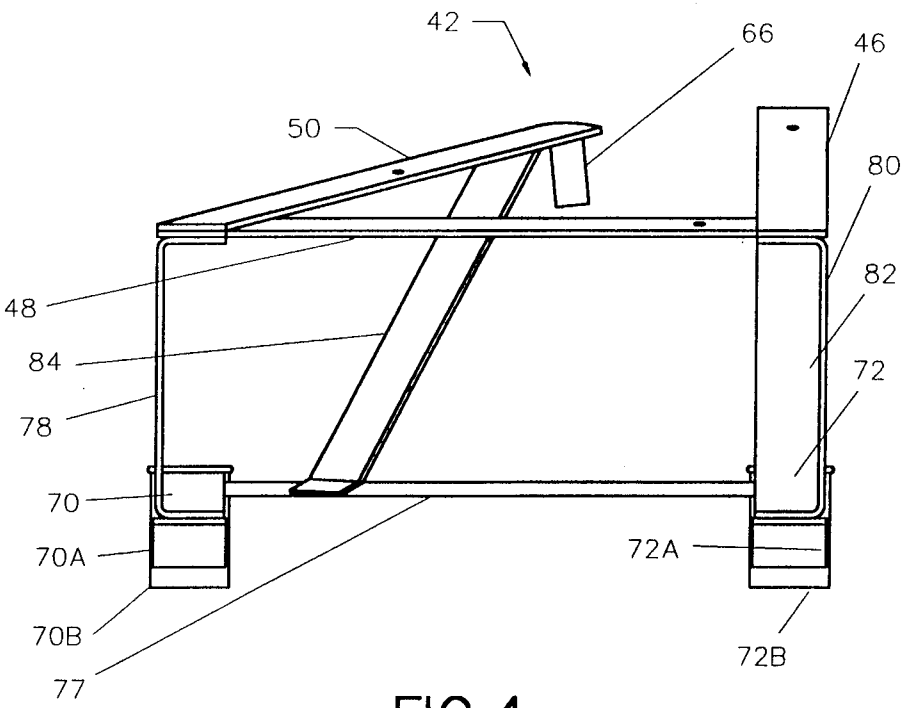
Figure 5:
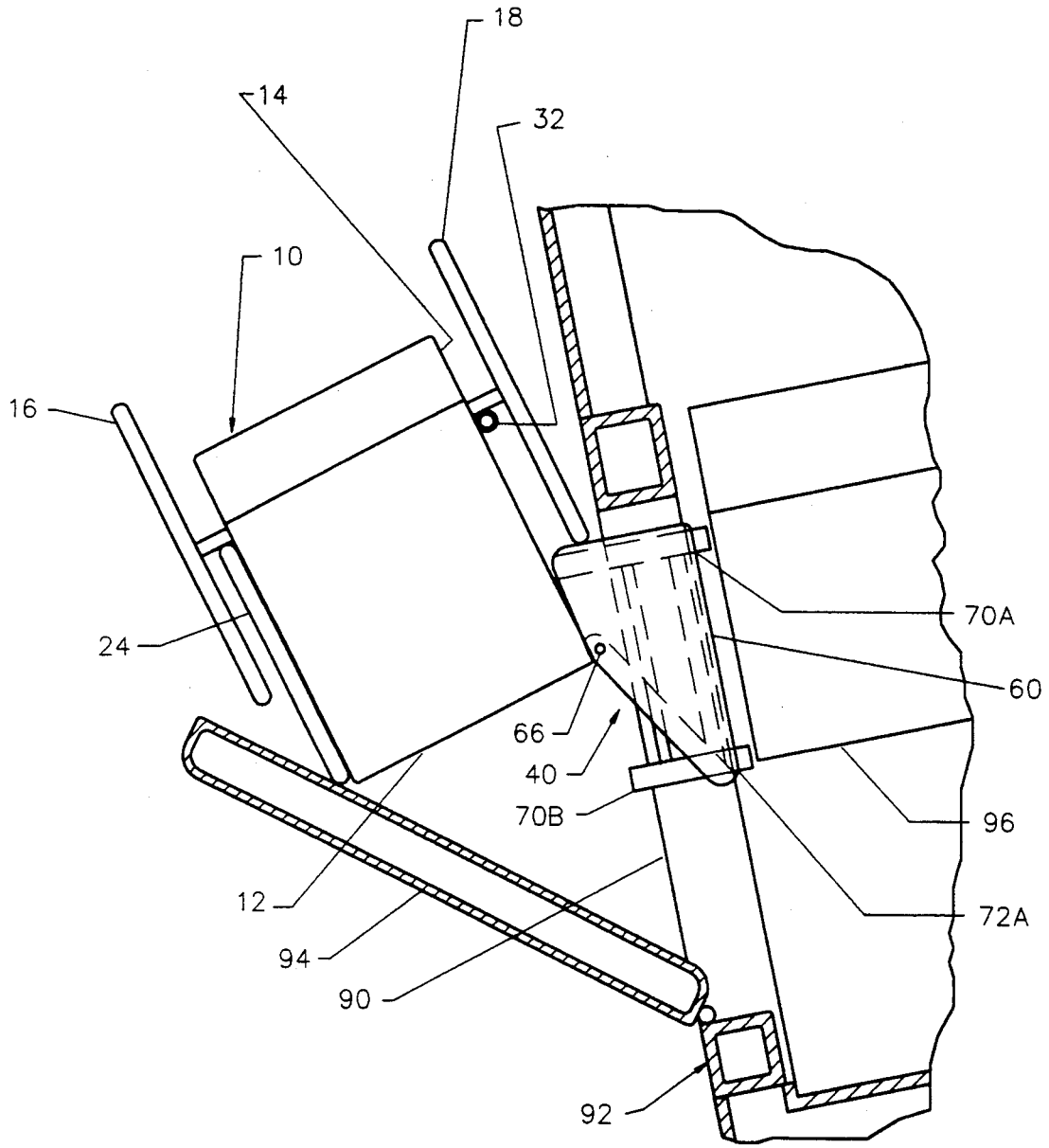

FIG. 4 is a side view of the frame for the transfer himself without assistance seat in FIG. 1; and, FIG. 5 is a fragmentary top view of an automobile showing a section of a front passenger seat, the lower door frame and open door with a wheelchair positioned as close as possible to the automobile seat, and a transfer seat in accordance with the present invention between the wheelchair seat and the automobile seat.

Wheelchairs customarily provide removable arms, and in certain wheelchairs, the removable arm slides within vertical tubes aligned at the corners of the wheelchair seat. It would be desirable to provide a transfer seat which would span the distance between the edge of an automobile seat and the side of the wheelchair seat when the wheelchair is positioned as close as possible to the seat of an automobile. It would further be desirable to provide a seat which would have one side supported on the frame of the automobile and the other side supported on the wheelchair, such that, a patient can safely transfer from one seat to the other by sliding himself across the transfer seat.

Two prior efforts to provide transfer seats are shown in U.S. Pat. Nos. 4,155,588 and 4,101,143, however, such prior devices have not been usable with automobiles having doors which open to angles which are substantially less than 90° with the door frame.

SUMMARY OF THE INVENTION

Briefly, the present invention is embodied in a transfer seat to be used between an automobile and a wheelchair. This seat is supported by a frame, one end of which is adapted to rest on the bottom frame of an automobile door, the other end of which is adapted to attach to the side of a wheelchair. The seat is shaped so as to project forwardly of a wheelchair when it is attached to the wheelchair, and having opposing side edges, one side of which is adapted to abut against the side of an automobile seat and the other side of which is adapted to abut against the side of a wheelchair seat.

DETAILED DESCRIPTION OF A PREFERRED EMBODIMENT TO THE INVENTION

Referring to FIG. 1, wheelchair 10 consists of a seat 12 with a back 14 and a pair of large drivewheels 16, 18 respectively. A pair of forwardly mounted caster wheels 20 and 22 permit steering of the wheelchair. There are also a pair of opposing removable arms 24, 26, each of which has two downwardly extending tubular support bars 28, 29, and 30, 31 respectively, each of which has a narrower lower tubular end 28*a*, 29*a*, 30*a*, and 31*a* respectively. On each side of the wheelchair 10 adjacent the corners of the seat 12 are upwardly projecting tubular support members 32, 33, 34 and 35. The tubular support members 32, 33, 34 and 35 are sized and positioned so as to slideably receive the lower portions 28*a*, 29*a*, 30*a*, 31*a* of the downwardly extending support bars 28, 29, 31, 32 respectively of the removable arms 24, 26. When the arm 26 is removed from the wheelchair 10, the tubular support members 32, 33 may be used for alternate purposes, such as, the attachment of a transfer seat 40 as in accordance with the present invention.

Figure 2:
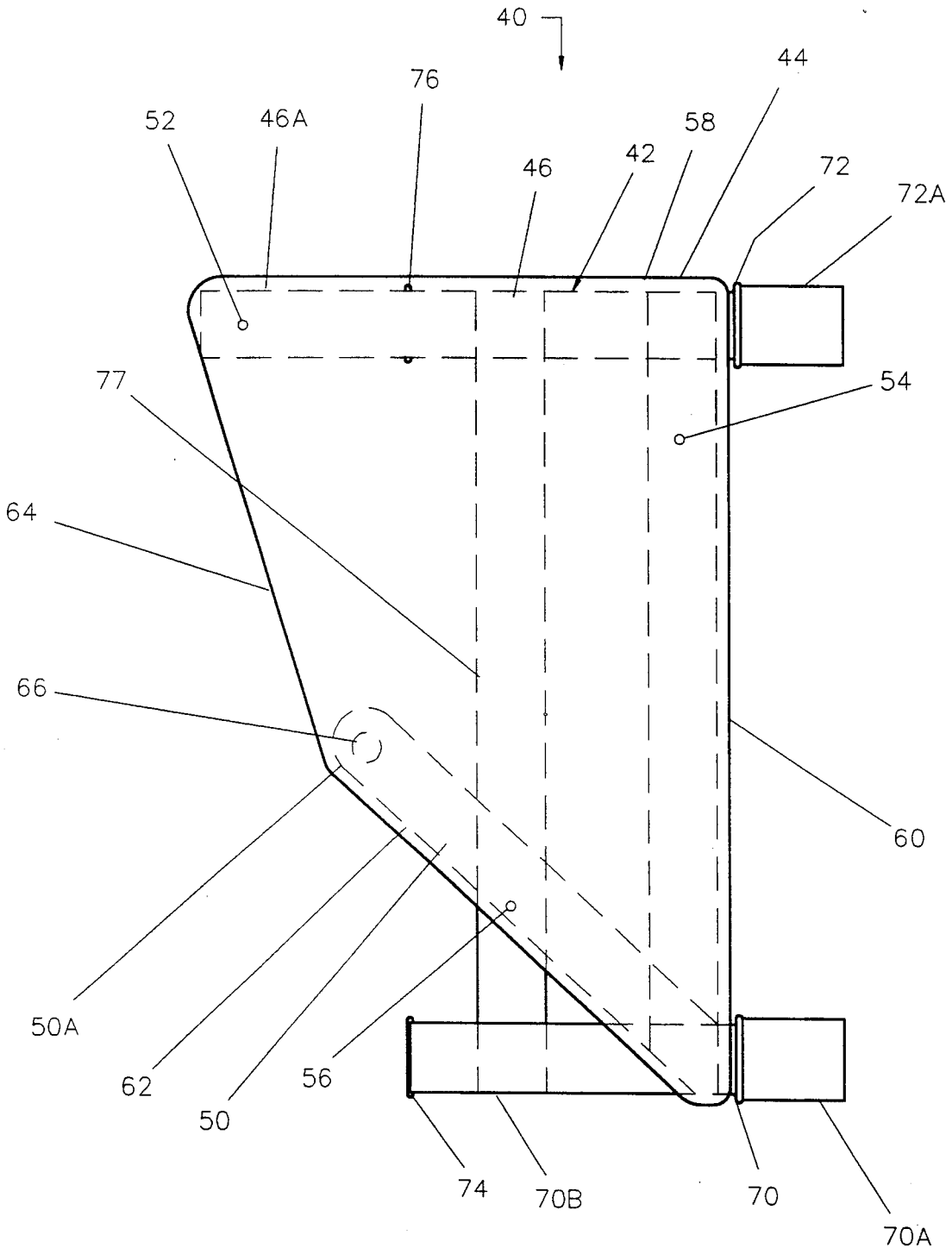
FIG. 2 is a top view of the transfer seat in FIG. 1 with portion of the frame shown in phantom line.
Figure 3:
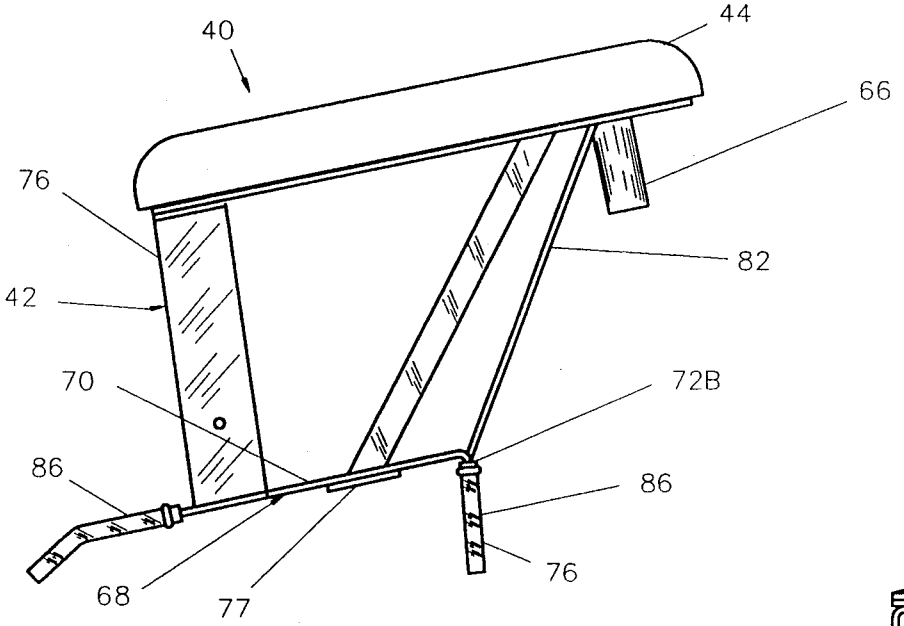
FIG. 3 is an end view of the transfer seat in FIG. 1.

Referring to FIG. 2, 3 and 4, the transfer seat 40 consists of a frame 42 and a seat 44. The frame 42 includes three horizontal seat support members 46, 48, 50, the upper surfaces of which all lie within the same plane. Holes 52, 54, 56 in the seat support members 46, 48, 50 respectively, are provided through which screws, not shown, are passed to attach the seat 44 to the upper surfaces of seat support members 46, 48, 50. Seat support members 46, 48 are at right angles to one another, whereas seat support member 50 is attached at an oblique angle of approximately 45 to seat support member 48. Furthermore, the outer end 50A of seat support member 50 is a shorter perpendicular distance from seat support member 48 than the outer end 46A of seat support member 46. Referring to FIG. 2, the perimeter of the seat 44 has four sides 58, 60, 62, 64. Sides 58 and 60 are at right angles to one another and these sides are adopted to fit over the support members 46 and 48 respectively. Side 62, which is fitted over seat support member 50 lies approximately at a 45° angle to side 60, and side 64 spans the distance between the outer ends 46A and 50A of support members 46 and 50.

As seen in FIG. 3, a downwardly extending peg 66 is provided at the distal end 50*a* of seat support member 50. The peg 66 is adapted to slide within the forward tubular support member 33 of the wheelchair 10.

The frame further includes a lower support section 68. The lower support section 68 consists of parallel horizontally extending feet 70, 72 having slightly downward turned outer ends 70*a* and 72*a* and inner ends 70*b* and 72*b* respectively. A pair of downwardly extending brace bars 74, 76 are attached to the inner ends 70*b*, 72*b* of the feet 70, 72 respectively. The feet are joined by a cross member 77. A pair of vertical support bars 78, 80 are each attached at their respective lower ends adjacent the outer ends 70*a*, 72*a* of the feet 70, 72 respectively, and the upper ends of support bars 78, 80 are attached to the intersections of seat support members 46, 48 and 48, 50 respectively. A third vertical support member 82 is attached at the lower end to inner end 72*b* of foot 72 and at it's upper portion to the distal end of seat support member 46. A fourth support member 84 extends angularly from a midpoint along cross member 77 to a point adjacent the distal end 50*a* of seat support member 50.

The frame 42 may be made of a suitable material, preferably steel, and the members may be fastened together by any appropriate means such as welding.

The outer ends of the feet 70*a*, 72*a* and the downward extending brace bars 74, 76 may be covered with a resilient covering 86 to prevent scratching of the automobile frame or damage to the upholstery of an automobile on which the seat is positioned.

The seat 40 is attached to a wheelchair 10 by sliding the peg 66 into the forward tubular support member 33. As seen in FIG. 5, the outer ends 70A, 72A of the feet 70, 72 are positioned on the lower door frame 90 of an automobile 92 when the wheelchair 10 is positioned between the door 94 and the door frame 90 of an automobile, and as near to the seat 96 of the automobile 92 as possible. The outer side 60 of the seat 44, abuts against the edge of the seat 94 of the automobile when the brace bars 74, 76 are resting against the outer edges of the door frame 90. When it is in this position, the transfer seat 40 provides a substantially level surface which extends from the seat 12 of the wheelchair 10 to the seat 94 of the automobile 92 across which a patient can move himself.

As can be seen in FIG. 5, when a wheelchair 10 is positioned as near as possible to the seat 96 of an automobile 92 the seat 12 of the wheelchair 10 cannot be brought up to a position where it is parallel to the automobile seat 96. The transfer seat 40 therefore extends horizontally from the side of the wheelchair 10 and forwardly of the wheelchair 10 in order to span the distance between the two seats.

While the present invention has been described in connection with one embodiment, it will be apparent to those skilled in the art that many changes and modifications may be made without departing from the true spirit and scope of the present invention. Therefore, it is intended by the appended claims to cover all such changes and modifications which come within the true spirit and scope of the invention.

What is claimed:

1. A transfer seat to be used between an automobile having a seat, a door, and a door frame, and a wheelchair having a seat and having first and second upwardly extending tubes on one side thereof for removably retaining an arm, the first upwardly extending tube positioned forwardly on the wheelchair relative to the second upwardly extending tube, the transfer seat comprising:

a frame having first and second ends, a foot on the first end of the frame adapted to support the frame on the door frame of the automobile, a downwardly extending peg on the second end of the frame adapted to be slidably fitted into the first upwardly extending tube for attaching the frame thereto and for rotation of the frame around the first upwardly extending tube, a seating surface above the frame which extends horizontally from one side of the wheelchair and extends angularly forwardly and outwardly from one side of the seat of the wheelchair when the peg is fitted into the first upwardly extending tube, and the seat surface having a generally trapezium shape and having a first side adapted to be positioned adjacent the seat of the wheelchair and a second opposing side, the second opposing side having a length longer than a length of the first side and extending forward of the seat of the wheel chair, the second side adapted to be positioned over the door frame and adjacent the seat of the automobile.

* * * * *